United States Patent [19]

Adams

[11] Patent Number: 4,765,686

[45] Date of Patent: Aug. 23, 1988

[54] ROTATABLE CUTTING BIT FOR A MINING MACHINE

[75] Inventor: Wayne F. Adams, Madisonville, Ky.

[73] Assignee: GTE Valenite Corporation, Troy, Mich.

[21] Appl. No.: 103,787

[22] Filed: Oct. 1, 1987

[51] Int. Cl.[4] ..... E21C 35/22

[52] U.S. Cl. ..... 299/81; 175/393

[58] Field of Search ..... 299/81, 86, 79, 12, 299/17; 175/393, 339

[56] References Cited

U.S. PATENT DOCUMENTS

| | | | |
|---|---|---|---|
| 1,388,490 | 8/1921 | Suman | 175/391 |
| 2,868,512 | 1/1959 | Sease | 175/340 |
| 4,251,109 | 2/1981 | Roepke | 299/12 |
| 4,333,687 | 6/1982 | Barnstorf | 299/81 |
| 4,405,178 | 9/1983 | Brandenburg | 299/81 |
| 4,453,775 | 6/1984 | Clemmow et al. | 299/81 |
| 4,456,306 | 6/1984 | Wrulich | 299/81 |
| 4,488,758 | 12/1984 | Clemmow et al. | 299/81 |
| 4,497,520 | 2/1985 | Ojanen | 299/86 |
| 4,573,744 | 3/1986 | Clemmow | 299/81 |
| 4,583,786 | 4/1986 | Thorpe et al. | 299/81 |
| 4,664,450 | 5/1987 | Radford | 299/81 |

FOREIGN PATENT DOCUMENTS

| | | | |
|---|---|---|---|
| 2932511 | 7/1979 | Fed. Rep. of Germany . | |
| 6551888 | of 1888 | United Kingdom | 299/81 |
| 2058175 | 4/1981 | United Kingdom | 299/81 |

*Primary Examiner*—Jerome Massie, IV
*Assistant Examiner*—David J. Bagnell
*Attorney, Agent, or Firm*—Robert E. Walter

[57] ABSTRACT

In a rotatable cutting bit of the type for delivering water under pressure to the work area being cut, the head portion includes an annular recess including a plurality of outlet ports facing forwardly and protected from the rearward flow of material being cut.

8 Claims, 1 Drawing Sheet

ROTATABLE CUTTING BIT FOR A MINING MACHINE

FIELD OF INVENTION

The present invention relates to a rotatable point-of-attack cutting bit or pick which delivers water under pressure to the work area.

BACKGROUND OF INVENTION

Bits or picks for mining spray water into the coal vein to suppress dust and cool the work area. Picks of this type are described in U.S. Pat. No. 4,664,450 to Radford. Typically, the picks are mounted in an array on the rim of a power-driven cutting wheel. The fluid usually water, under pressure, is supplied to holders mounted on the periphery of the drum. The picks have an inlet connected to the water supply and an outlet which directs water to the work area. Typically, the holder includes a socket within which the shank of the mineral mining pick is received. The pick should rotate in the socket to maintain the sharpness of the hard cemented carbide cutting insert located at the tip. A tubular spigot or water tube located within the socket extends longitudinally toward the open end. The inner end of the spigot communicates with a fluid supply passage and the outer end extends into an axial opening in the pick. Various techniques for delivering water to the axial opening in the pick are known in the prior art. Similarly, various means are known to retain the pick in the socket of the holder during cutting while permitting rotation of the pick.

The prior art has located outlet ports at various locations on the peripheral surface of the head portion of the cutter bit. U.S. Pat. No. 4,405,178 illustrates a cutter bit having a plurality of outlets or nozzle-like exit orifices adjacent the cemented carbide cutting tip. Other conventional prior art devices have located the outlet ports at a position spaced from the carbide insert and facing in a forward direction parallel to the axis of rotation. Such picks taper outwardly from the tip to a radially projecting ledge. The ledge has a forwardly facing surface on which the outlet ports are mounted. Since the ledge is perpendicular to the axis of rotation of the bit, the ports face forwardly directly into the work area. As the bit attacks the work to be cut, detritus flows rearwardly over the head portion of the pick. The outlet ports tend to plug so that proper delivery of water to the work area is prevented. If water delivery is used intermittently, the outlet ports tend to clog with packed detritus during the cutting interval when the water supply is shut off. When the water delivery is resumed, the clogged outlet ports can misdirect or even prevent the spray from reaching the work area. Thus, the picks can be rendered ineffective prior to the end of their normally useful life.

SUMMARY OF THE INVENTION

It is an object of the present invention to develop a point- of-attack bit with outlet ports which tend to remain unclogged during the normally useful life of the bit or pick.

In accordance with the present invention, there is provided a rotatable cutting bit for the delivery of fluid under pressure to the work area being cut. The pick comprises a head portion having a forwardly facing hard insert and a plurality of outlet ports for emitting a stream of water. The shank portion depends from the head portion along a longitudinal axis and includes a central passage. Within the pick body, outlet ports are connected to the central passage for the flow of fluid. The head includes an annular recess radially spaced from the longitudinal axis and extending entirely around the periphery of the head. The annular recess forms a forwardly facing surface and a rearwardly facing surface. The outlet ports are positioned along the forwardly facing surface for directly a stream of water in a forward direction at an acute angle with the longitudinal axis. The rearwardly facing surface forms a lip for protecting the outlet ports from the rearward flow of detritus generated from the work being cut.

DETAILED DESCRIPTION OF THE PREFERRED EMBODIMENT

Figure 1:
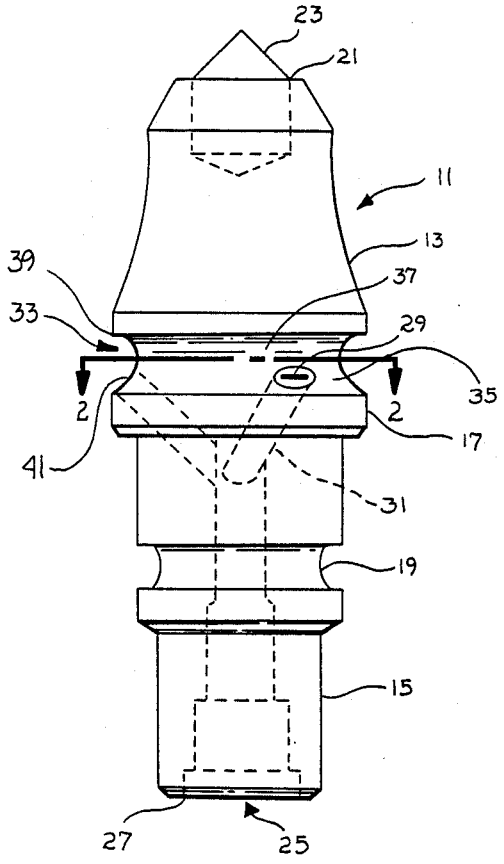
FIG. 1 is a side elevational view of a bit.

As illustrated in FIG. 1, the pick 11 has a forwardly facing enlarged head 13 and a depending shank 15. The head 13 and shank 15 are coaxially aligned along the longitudinal axis which corresponds to the axis of rotation. The head 13 has an enlarged section 17 which prevents the head from being forced into the bore in the mounting block. The shank 15 which has a cylindrical configuration rotatably fits into a matching bore on a block or holder.

As illustrated in FIG. 1, the shank 15 has a peripheral groove 19 to engage a retaining means positioned in the bore of the holder. Such a retaining means is in the form of a resilient bar which extends transversely to the bore so as to engage the groove 19 in shank 15. It is contemplated that other retainers such as sleeves or rings may be used provided rotation of the pick 11 is permitted. Generally, the picks are mounted on the circumferential surface of a drum at an angle with respect to the axis of rotation of the drum. As the pick strikes the work, forces on the head of the pick tend to rotate the pick so that the pick wears evenly.

The head 3 includes a forwardly facing socket 21 for receiving a hard insert 23 typically made of cemented carbide such as tungsten carbide in a matrix of cobalt. The insert 23 is typically brazed into the socket. The hard insert 23 has a shape which tapers outward from a point and is symmetrical about the axis of rotation.

As illustrated in FIG. 1, the peripheral surface of the head 13 is generally symmetrical about the longitudinal axis of the pick 11. Typically, the head 13 tapers outwardly from a relatively narrow widthwise section near the hard insert 23 to the enlarged section 17 near the shank. The peripheral surface of the head 13 may include projections or fins to help impart rotation to the pick 11 as the work is being struck.

Figure 3:
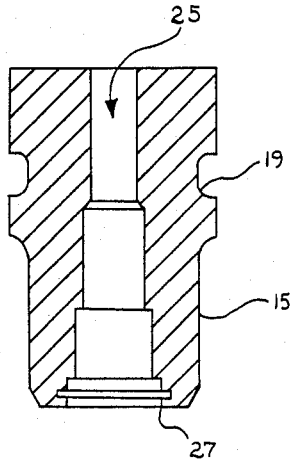
FIG. 3 is a partial sectional view.

As illustrated in FIG. 3, the shank 15 includes a central passage 25 for the flow of fluid. The passage 25 which extends along the longitudinal axis of the pick 11 has a fluid inlet at the rear end or base of the shank 15. The forward portion of the passage 25 communicates with a plurality of outlet ports 29 positioned on the peripheral surface of the head 13. A plurality of radially extending fluid passages 31 connect the axially aligned passage 31 to the outlet ports 29.

In accordance with the principles of the present invention, the head 13 includes an annular recess 33 extending entirely around the periphery of the head 13. As illustrated in the drawing, the annular recess 33 is preferably adjacent the enlarged section 17 of the head 13. The annular recess 33 and radially extending passage 31 reduce the cross-sectional area of the material and, hence, the strength of the head 13 in the area of the annular recess 33. Thus, it is preferred to position the annular recess 33 and outlet ports 29 at the enlarged section 17. The annular recess 33 includes a forwardly facing surface 35 and a rearwardly facing surface 37. The plurality of outlets ports 29 are positioned along the forwardly facing surface 35 for directing a stream of water in a forward direction at acute angle with the longitudinal axis. The rearwardly facing surface 37 forms a lip 39 for protecting the outlet ports 39 from the rearward flow of the work being cut.

Figure 2:
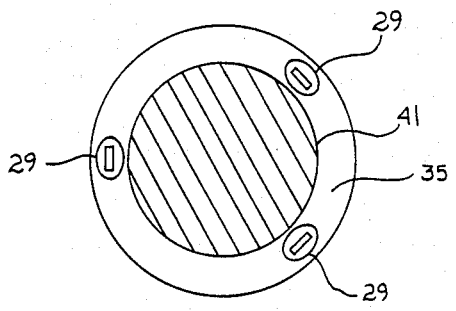
FIG. 2 is a cross-sectional view along section 2—2 of FIG. 1.

As illustrated in FIG. 2, the outlet ports 29 are in the form of elongated slots. The slots have a longer opening in the lengthwise direction than in the widthwise direction. The slots are aligned lengthwise with the longer opening along a circumferential direction. Preferably, three outlet ports 29 spaced equal distance along the rearward surface so that the spray pattern envelops the head 13.

The lip 39 preferably projects outwardly in a radial direction perpendicular to the axis of rotation a sufficient amount so as to extend radially up to and preferably entirely beyond the opening of the outlet port 29. When viewed from a top view facing the hard insert, the lip 39 preferably completely hides the outlet ports 29.

The rearwardly and forwardly facing surfaces 33, 35 join at a juncture 41 spaced at a predetermined radial distance from the longitudinal axis. The rearwardly and forwardly facing surfaces 33, 35 are oriented so that path of the spray from the outlet ports 29 is unobstructed. Preferably, the forwardly facing surface 35 is positioned at an obtuse angle with respect to the longitudinal axis, preferably from about 120 to about 150 degrees, more preferably from about 130 to about 140 degrees.

In operation, water under pressure is forced through the outlet ports 29 so as to envelop the head and suppress the rearwardly flowing detritus. When the water supply is shut off, the rearwardly flowing detritus tends to flow over the outlet ports 29 rather than directly impinging on the outlet ports 29. Since the outlet ports 29 are not directly in the path of the detritus, the openings tend to remain unclogged. When the water supply is resumed, the water flows through the outlet ports 29.

I claim:

1. A rotatable cutting bit for the delivery of fluid under pressure to a work area being cut comprising, a head portion having a forwardly facing hard insert and a plurality of outlet ports for emitting a fluid, a shank portion depending from said head portion along a longitudinal axis and including a fluid passage, said outlet ports being connected to said passage for the flow of fluid, said head having an annular recess radially spaced from the longitudinal axis and extending entirely around the periphery of said head, said annular recess forming a forwardly facing surface and a rearwardly facing surface, said outlets being positioned along said forwardly facing surface for directing a stream of water in a forward direction at an acute angle with the longitudinal axis for enveloping said head with a spray of fluid, said rearwardly facing surface forming a lip for protecting said outlet ports from the rearward flow of work being cut.

2. A rotatable cutting bit for the delivery of fluid according to claim 1 wherein said head includes an enlarged portion adjacent said shank, said annular recess being positioned in said enlarged section.

3. A rotatable cutting bit for the delivery of fluid according to claim 1 wherein said outlet ports are in the shape of elongated slots wherein the elongated portion of said slot is aligned in the circumferential direction.

4. A rotatable cutting bit for the delivery of fluid according to claim 3 wherein said lip projects outwardly in a radial direction at least up to said outlet ports.

5. A rotatable cutting bit for the delivery of fluid according to claim 3 wherein said outlet ports comprise elongated slots oriented so as to envelop said head.

6. A rotatable cutting bit for the delivery of fluid according to claim 5 wherein at least three outlet ports are provided along said forwardly facing surface, said outlet ports being spaced an equal distance apart.

7. A rotatable cutting bit for the delivery of fluid according to claim 3 wherein said forwardly facing surface extends outwardly in a radial direction from the junction with the rearwardly facing surface at an obtuse angle with the longitudinal axis of said bit.

8. A rotatable cutting bit for the delivery of fluid according to claim 7 wherein said obtuse angle is from about 130 to 140 degrees.

* * * * *